US005431597A

United States Patent [19]

Anderson

[11] Patent Number: 5,431,597

[45] Date of Patent: Jul. 11, 1995

[54] SKATE BLADE EDGE RESURFACER

[75] Inventor: Bradley J. Anderson, Alexandria, Minn.

[73] Assignee: Edge Specialties, Inc., Alexandria, Minn.

[21] Appl. No.: 44,749

[22] Filed: Apr. 12, 1993

[51] Int. Cl.[6] ..... B23F 21/03

[52] U.S. Cl. ..... 451/558; 451/545; 451/541; 451/45; 76/83; 76/88

[58] Field of Search ..... 51/205 WG, 205 R, 211 R, 51/204, 206 R, 211 H, 214, 285, 208; 76/83, 88

[56] References Cited

U.S. PATENT DOCUMENTS

| | | | |
|---|---|---|---|
| D. 295,142 | 4/1988 | Patrick | D8/91 |
| 594,723 | 11/1897 | Boettcher . | |
| 1,006,000 | 10/1911 | Oosdyke . | |
| 1,273,624 | 7/1918 | Krollius . | |
| 2,054,495 | 9/1936 | Corkum . | |
| 2,092,831 | 9/1937 | Cannon | 51/205 WG |
| 2,118,617 | 5/1938 | Nicolet | 51/205 WG |
| 2,398,566 | 4/1946 | Talbert . | |
| 2,428,473 | 10/1947 | Slocum . | |
| 2,550,765 | 5/1951 | Brown . | |
| 3,841,030 | 10/1974 | Laszlo | 51/170 PT |
| 4,219,975 | 9/1980 | Scholler | 51/205 WG |
| 4,910,923 | 3/1990 | McCabe | 51/205 WG |
| 5,197,232 | 3/1993 | Ellestad | 51/205 WG |

*Primary Examiner*—Bruce M. Kisliuk
*Assistant Examiner*—Eileen P. Morgan
*Attorney, Agent, or Firm*—Burd, Bartz & Gutenkauf

[57] ABSTRACT

A hand held skate blade sharpening tool has a rotatable sharpening stone retained within a channel-shaped body member. Removable pins mounted on the body are located adjacent the outer ends of the stone to limit longitudinal movement of the stone within a channel of the body member. The body member has an access slot extending radially from the stone. Elongated guides projecting upwardly adjacent the slot are transversely spaced at a distance substantially the same as the width of the skate blade to guide and limit lateral movement of the blade within the slot. A transverse groove interrupting the slot and guides is open to the channel exposing the stone. This enables the stone to be manually rotated within the channel to rotate an unused sharpening surface into alignment with the slot.

28 Claims, 3 Drawing Sheets

SKATE BLADE EDGE RESURFACER

FIELD OF THE INVENTION

The invention relates to tools for sharpening ice skate blades, particularly skate blades having two edges located between a hollow concave curved surface.

BACKGROUND OF THE INVENTION

Commonly, ice skates are sharpened or touched-up using a rotating grinding wheel of a grinding machine. The grinding machine takes a sizeable cut out of the blade each time it is used to sharpen the blade which reduces the useful life of the blade. The blades become excessively sharp increasing the risk of injury. Also, the cost of using the grinding machine limits the number of times a skater can affordably sharpen his or her skates.

An alternative to the grinding machine is to use hand held sharpening tools. These tools have a stone that is moved back and forth lengthwise along the skate blade. The stone sharpening surface quickly wears or becomes dirty whereby the tool has to be replaced.

SUMMARY OF THE INVENTION

The invention is directed to a hand operated ice skate sharpening tool that functions to prolong skate blade life and lower costs associated with conventional grinding methods of skate sharpening. The sharpener has a cylindrical sharpening stone rotatable within a housing whereby unused surfaces of the stone can be rotated and used to sharpen ice skate blades. The stone is easily removed from the housing for replacement or cleaning of the stone.

The sharpener has a generally rectangular body with opposite ends. A cylindrical bore extends longitudinally through the body. The bore is open to each end of the housing. A cylindrical stone is located in the bore for sharpening edges of a skate blade. The diameter of the stone is slightly less than the diameter of the bore so that the stone can be rotated within the bore to position unused surfaces of the stone adjacent the edges of the skate blade. The stone has a convex curved outer surface that is complementary to the concave on the bottom surface of the blade. The stone can be removed from the bore through one of the open of the body for replacement or cleaning purposes. Pins located in holes in the body adjacent the ends of the stone extend into the bore to fix the longitudinal position of the stone within the bore. Each pin has open side ends so that the diameter of the pin can be reduced to remove the pin from the hole and thereby facilitate removal of the stone from the bore.

The body of the sharpener has an elongated slot that extends generally parallel to the longitudinal axis of the bore. The slot is open to the top of the bore and also to the opposite ends of the body. This provides access to the outer surface of the stone for the blade to be sharpened. After being prepped with honing oil the blade is inserted into the slot to position the bottom surface of the blade in engagement with the outer surface of the stone. Upwardly projecting flanges joined to the body adjacent the slot have inner surfaces aligned with the outer sides of the slot. The sharpener is then mowed lengthwise along the blade in both longitudinal directions to sharpen the edges of the blade. The slot has a width substantially the same as the width of the blade to prevent lateral movement of the blade within the slot. Flanges guide the blade as the sharpener is moved relative to the blade. The sharpening procedure results in blade edges having a non-excessive sharpness facilitating skating and reducing risk of injury. A transverse groove in the sharpener body has a bottom portion that intersects the top portion of the bore. This exposes the top surface of the stone to facilitate the rotation thereof within the bore. The user uses a thumb or finger to slightly rotate the stone and position an unused surface of the stone in alignment with the slot. When all of the outer surface of the stone becomes worn the stone can be replaced by removing the pin from the housing and removing the stone from the bore.

DESCRIPTION OF THE PREFERRED EMBODIMENT

Figure 1:
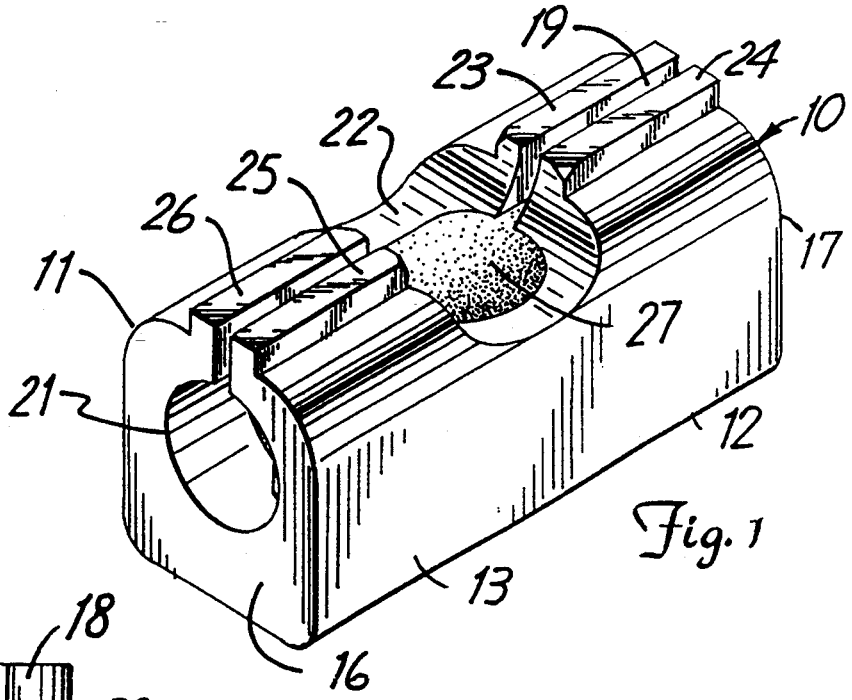
FIG. 1 is a perspective view of an ice skate sharpener of the invention.
Figure 2:
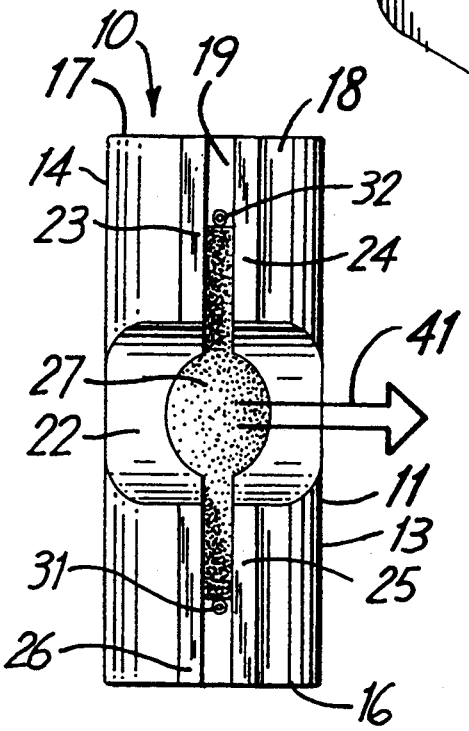
FIG. 2 is a top view of FIG. 1.

Referring to FIGS. 1 and 2, there is shown an ice hockey skate blade sharpener indicated generally at 10. Blade sharpener 10 is used to make a concave groove 34 and define bottom edges 36 and 37 of an ice hockey skate blade 33. Sharpener 10 is a hand held device that can be carried in an equipment bag and used at rink side to sharpen blade 33 to the user's personal preference to match ice conditions and the like.

Sharpener 10 has a generally rectangular body 11 having a flat bottom surface 12 that curves upwardly into a pair of upright side walls 13 and 14. Body 11 has generally flat ends 16 and 17 that extend between side walls 13 and 14. Upper portions of side walls 13 and 14 curve inwardly to define a top wall 18 and body 11.

Figure 8:
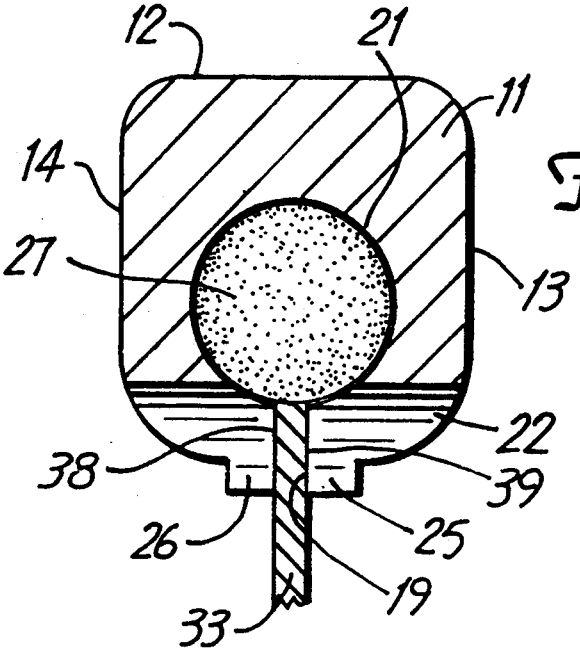
FIG. 8 is a sectional view taken along the line 8—8 of FIG. 7.

A slot 19 extends longitudinally on top wall 18 along the length of body 11. Slot 19 is open to each end 16 and 17 of body 11. As shown in FIG. 8, slot 19 has a width that is substantially the same as the width of blade 33. The body 11 has a centrally located cylindrical bore 21 that extends the length of body 11 and is open to ends 16 and 17. The top of bore 21 is open to slot 19. Slot 19 can have different widths to accomodate blades having different widths.

Figure 5:
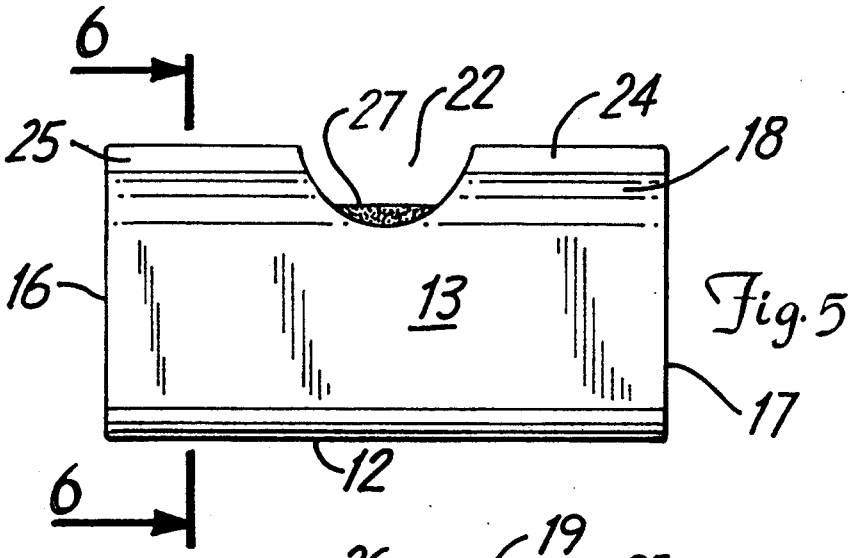
FIG. 5 is a side view of FIG. 1.

Referring to FIGS. 1, 2 and 5, body 11 has transverse groove or U-shaped recess 22 in top wall 18 that interrupts slot 19. The bottom of groove 22 intersects a top portion of bore 21 adjacent a mid-point of bore 21. Upwardly projecting flanges 23, 24, 25 and 26 are joined to top wall 18 adjacent groove 22. Flanges 23 to 26 have transversely spaced inner surfaces, generally parallel to the inner surfaces of body 11 that form the upper portion of slot 19. Flanges 23 to 26 function to guide skate blade 33 and prevent lateral movement of the blade during the sharpening procedure as hereinafter described.

Figure 6:
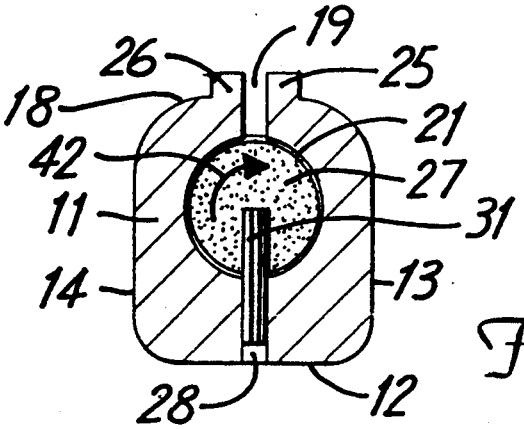
FIG. 6 is a sectional view taken along the line 6—6 of FIG. 5.

Referring to FIGS. 2 and 6, a generally cylindrical skate sharpening material or stone 27 is located in bore 21 of body 11. Stone 27 has a diameter that is slightly less than the diameter of bore 21 whereby stone 27 can be rotated in bore 21, as shown by arrows 41 and 42 of FIGS. 2 and 6, respectively. Stone 27 has a convex curved outer surface that is complementary to concave curve 34 on the bottom of skate blade 33. Stone 27 is rotated to align an unused sharpening surface with the lower end of slot 19. Stone 27 can be removed from bore 21 for replacement or cleaning purposes. The outer surface of stone 27 can have different convex curves to complement different concave curves on the bottom of other skate blades.

Figure 3:
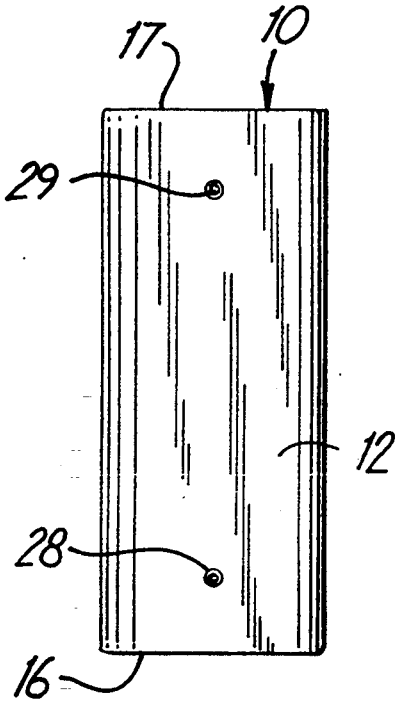
FIG. 3 is a bottom view of FIG. 1.
Figure 4:
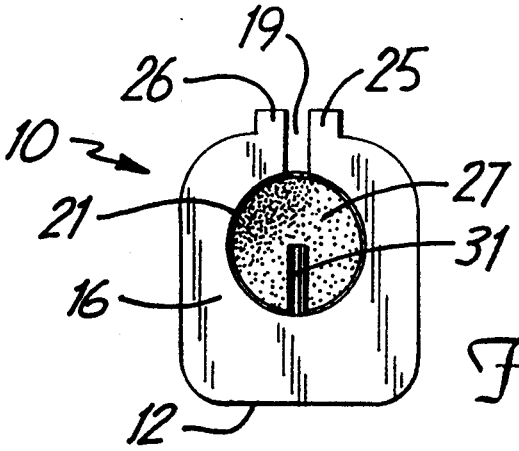
FIG. 4 is an end view of FIG. 1.

Referring to FIG. 3, body 11 has a pair of holes 28 and 29 that extend normal to bottom wall 12 and are open to bore 21 adjacent opposite ends of stone 27. Each hole 28, 29 has a diameter that is less than the width of slot 19. Stops or pins 31 and 32 are inserted into holes 28 and 29, respectively, and project upwardly into bore 21 to limit the longitudinal movement of stone 27 relative to body 11. Holes 28 and 29 are open to bottom wall 12 whereby a punch (not shown) or similar tool can be used to remove pins 31, 32 from holes 28, 29. Pins 31, 32 are generally tubular members having open ends to form a split sleeve. This allows the diameter of pins 31, 32 to be reduced so that pins 31, 32 can be inserted into and removed from holes 28, 29 to facilitate removal of stone 27 from bore 21. When pins 31, 32 are in position adjacent the opposite ends of stone 27, pins 31, 32 expand into tight-fit engagement with body 11 within holes 28 and 29.

Figure 7:
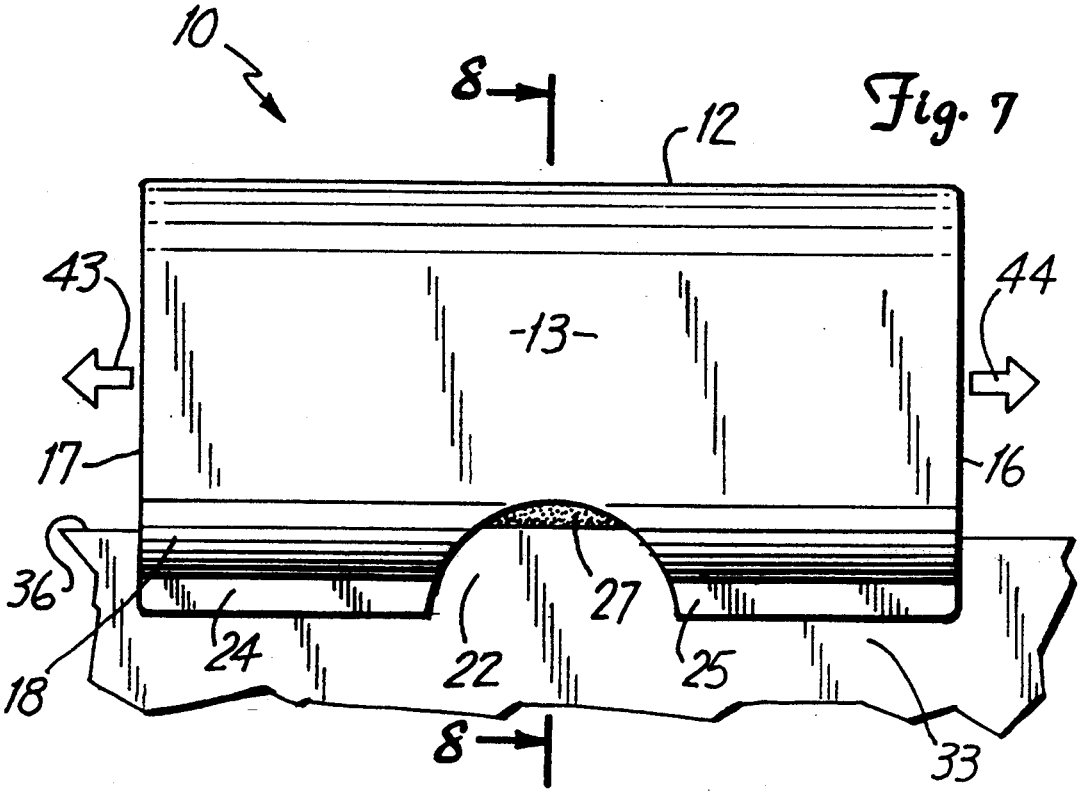
FIG. 7 is an enlarged side view of the skate sharpener of FIG. 1 inserted on a blade of an ice skate.
Figure 9:
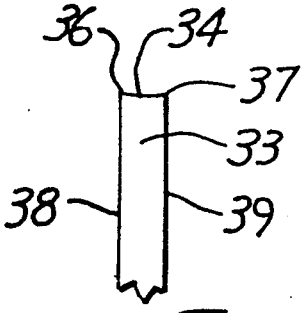
FIG. 9 is a partially sectioned end view of a ice skate blade showing the concave curved bottom surface of the blade.

In use, blade 33 is positioned on a stable surface with groove 34 facing upwardly. Drops of honing oil are placed along the length of blade 33 to lubricate the blade. Sharpener 10 is inverted, as shown in FIGS. 8 and 9, and slot 19 is aligned with the longitudinal exterior of blade 33. Side walls 13 and 14 of body 11 are gripped with the thumb and fore fingers of one hand of the user. The other hand is placed through the opening in the blade holder of the skate to temporarily fix the position of blade 33. Sharpener 10 is installed on blade 33 by moving blade 33 into slot 19 and into engagement with stone 27. The width of slot 19 is substantially the same as the width of blade 33 whereby sides 38 and 39 of blade 33 are located adjacent the inner surfaces of body 11 that define slot 19. This prevents lateral movement of blade 33 within slot 19 and prevents skewing of blade edges 36 and 37 during the sharpening process. The inner surface of flanges 23 to 26 slidable engage sides 38 and 39. The operator moves sharpener 10 back and forth lengthwise along blade 33, as indicated by arrows 43 and 44 in FIG. 7, several times using minimal downward pressure. Flanges 23 to 26 function to guide blade 33 longitudinally within slot 19 relative to stone 27. The honing oil on blade 33 reduces friction between sides 38 and 39 and the inner surface of flanges 23 to 26 to reduce the force required for the sharpening stroke of the operator.

Sharpener 10 is then lifted off blade 33 to bring stone 27 out of engagement with the blade. The thumb of the operator is placed into groove 22 and used to slightly rotate stone 27, as indicated by arrows 41 and 42 in FIGS. 2 and 6, whereby an unused surface of stone 27 is located directly below the bottom of slot 21. Sharpener 10 is reinstalled on blade 33 by positioning blade 33 in slot 19 into engagement with stone 27. The sides 38 and 39 of blade 33 slidably engage the inner surfaces of flanges 23 to 26 and the inner surfaces of body 11 defining slot 19 preventing lateral movement of blade 33 within slot 19. The operator moves sharpener 10 back and forth lengthwise along blade 33 as shown by arrows 43 and 44 in FIG. 7. Flanges 23 to 26 guide blade 33 within slot 19. The rotating of stone 27 and blade 33 sharpening procedure is repeated until surface 34 has a smooth concave shape.

To finish blade 33, sharpener 10 is removed from blade 33 and a generally flat stone (not shown) is placed on a side 38 of blade 33. The flat stone is moved back and forth along the length of side 38 adjacent edge 36 to remove burrs and other imperfections on blade 33. The flat stone is used to finish opposite side 39 of blade 33 in like manner. When both sides 38 and 39 of blade 33 have been worked with the flat stone, excess oil is removed from blade 33 with a cloth or towel.

While there has been shown and described a preferred embodiment of the ice skate blade sharpener according to the present invention, it is understood that changes in structure, materials and design can be made by persons skilled in the art without departing from the substance of the invention. The invention is defined in the following claims.

I claim:

1. A device for sharpening the blade of an ice skate comprising: a body having a bottom wall, end walls and a top wall joined to the opposite end walls, a longitudinal bore open to each end wall, and a longitudinal slot extended normal to the top wall and open to the bore and each end wall for accommodating the blade, lip means projecting upwardly normal to the top wall and adjacent opposite sides of the slot locating the blade in the slot, a cylindrical stone means rotatably supported by the body in the bore and engageable with a blade of a skate located in the slot to sharpen the blade, said stone means having opposite ends, said bottom wall having a transverse first hole open to the bore adjacent one end of the stone means and a transverse second hole open to the bore adjacent the other end of the stone means, stop means removably mounted on the body for holding the stone means within said bore to limit longitudinal movement of the stone means relative to the body, said stop means comprising a first pin located in said first hole and extended into the bore adjacent said one end of the stone means and a second pin located in said second hole and extended into the bore adjacent said other end of the stone means whereby said first and second pins limit longitudinal movement of the stone means relative to the body, said pins being vertically aligned with the slot adjacent opposite ends of the stone means whereby the pins can be removed from the bore of the body to allow removal of the stone means from the body, and a transverse concave curved groove extended into the lip means and top wall through the slot, the top wall and lip means having a concave curved bottom portion intersecting a top portion of the bore forming said groove whereby the stone means can be manually rotated within said bore to position a selected portion of the stone means adjacent the slot when the blade is removed from the slot.

2. The device of claim 1 wherein: the pins of the stop means removably mounted on the body are laterally spaced from the slot.

3. The device of claim 1 wherein: the pins are located with a tight friction fit in the holes in the body, each pin being removable from the bore to allow the stone means to be removed from the body.

4. The device of claim 1 wherein: the stone means is generally cylindrical member having a diameter that is slightly less than a diameter of the bore.

5. The device of claim 1 wherein: the stone means has a convex curved outer surface complementary to a concave curved bottom surface of the blade.

6. The device of claim 1 wherein: the longitudinal slot has a width substantially the same as a width of the blade of an ice skate.

7. The device of claim 1 wherein: the lip means comprise transversely spaced flanges, each flange having a inner surface vertically aligned with an outer side of the slot.

8. The device of claim 7 wherein: the transverse distance between the inner surfaces of the flanges is substantially the same as a width of the slot.

9. A device for sharpening the blade edges of an ice skate comprising: a body having a top wall joined to opposite end walls, a bore extended longitudinally through the body and open to the end walls, a longitudinal slot extended normal to the top wall and open to the bore and end walls of the body, lip means projecting upwardly normal to the top wall, the lip means having transversely spaced surfaces located in general vertical alignment with outer sides of the slot, cylindrical stone means having opposite ends, the stone means located in the bore for sharpening edges of a skate blade, the stone means having a diameter slightly less than a diameter of the bore to allow rotational movement of the stone means relative to the body, said body having a transverse first hole open to the bore adjacent one end of the stone means and a transverse second hole open to the bore adjacent the other end of the stone means, stop means removably mounted on the body located in the bore in each end wall and engageable with the opposite ends of the stone means to limit longitudinal movement of the stone means relative to the body whereby when the blade is inserted into the slot positioning a bottom surface of the blade into engagement with the stone means, the body can be moved longitudinally relative to the blade to sharpen the edges of the blade, said stop means comprising a first pin located in said first hole and extended into the bore adjacent said one end of the stone means and a second pin located in said second hole and extended into the bore adjacent said other end of the stone means whereby said first and second pins limit longitudinal movement of the stone means relative to the body, each pin being vertically aligned with and laterally spaced from the slot, at least one pin being movable relative to the body to remove the one concave curved groove extended into the lip means and top wall through middle portions of the slot and lip means, the lip means and top wall having a concave curved bottom portion intersecting a top portion of the bore forming said groove whereby the stone means can be manually rotated with the bore to position a selected portion of the sleeve means adjacent the slot when the blade is removed from the slot.

10. The device of claim 9 wherein: the one of said pins is located with a tight fit in a hole in the body whereby the one of said pins can be removed from the body.

11. The device of claim 9 wherein: the stone means is a generally cylindrical member of stone material having a diameter that is slightly less than the diameter of the bore.

12. The device of claim 9 wherein: the stone means has a convex curved outer surface complementary to a concave curve of the bottom surface of the blade.

13. The device of claim 9 wherein: the slot has a width substantially the same as a width of the blade.

14. The device of claim 9 wherein: the transverse distance between the transversely spaced surfaces of the lip means is substantially the same as a width of the slot.

15. A skate blade edge sharpener comprising: body means having a cylindrical bore open to opposite ends of the body means, a cylindrical member of stone material located in the bore for sharpening edges of a skate blade, the member having a diameter being less than a diameter of the bore whereby the cylindrical member is rotatable in the bore, the cylindrical member having opposite ends, said body means having a transverse first hole open to the bore adjacent one end of the cylindrical member and a transverse second hole open to the bore adjacent the other end of the cylindrical member, stop means mounted on the body means projecting into the bore adjacent the opposite ends of the cylindrical member to limit longitudinal movement of the cylindrical member relative to the body means, said stop means, comprising a first pin located in said first hole and extended into the bore adjacent said one end of the cylindrical member and a second pin located in said second hole and extended into the bore adjacent said other end of the cylindrical member whereby said first and second pins limit longitudinal movement of the cylindrical member relative to the body means, at least one of said pins being removable from the bore of the body means to permit said cylindrical member to be removed from the body means, the body means having an elongated slot extended generally parallel to the bore, the slot having a fixed width and being open to the bore and to the opposite ends of the body means providing access to an outer surface of the cylindrical member whereby when the blade is inserted into the slot positioning a bottom surface of the cylindrical member, the body means can be moved longitudinally relative to the blade to sharpen the edges of the blade, and recess means in said body means open to the bore, the recess means comprising a transverse groove extended through the body means, the groove having a portion of the bore whereby the cylindrical member can be manually rotated within said bore to position a selected portion of the cylindrical member adjacent the slot.

16. The sharpener of claim 15 wherein: the body means includes upwardly projecting transversely spaced flanges, each flange having an inner surface vertically aligned with an outer side of the slot.

17. The sharpener of claim 16 wherein: the transverse distance between the inner surfaces of the flanges is substantially the same as a width of the slot.

18. The sharpener of claim 15 wherein: the slot has a width substantially the same as a width of the blade.

19. The sharpener of claim 15 wherein: the outer surface of the stone has a convex curve that is complementary to a concave curve of the bottom surface of the blade.

20. The sharpener of claim 15 wherein: said one of said pins is mounted with a tight fit in a hole in the body means and vertically aligned with the slot whereby said one of said pins can be removed from the bore of the body means.

21. A device for sharpening a longitudinal blade comprising: a body having opposite end walls and a longitudinal wall extended between the opposite end walls, said body having a longitudinal cylindrical bore open to each end wall and a longitudinal slot extended normal to the longitudinal wall and open to the bore and each end wall for accommodating the blade, cylindrical means located in the bore engageable with the blade located in the slot to sharpen the blade, the cylindrical means having opposite ends and being rotatably supported by the body within the bore, said body having a first transverse hole open to the bore adjacent one end of the cylindrical means and a transverse second hole open to the bore adjacent the other end of the cylindrical means, stop means mounted on the body and projected into the bore to limit longitudinal movement of the cylindrical means relative to the body, said stop means including a a first member located in said first hole and extended into the bore adjacent said one end of the cylindrical member and a second member located in said second hole and extended into the bore adjacent said other end of the cylindrical member whereby the first and second members limit longitudinal movement of the cylindrical member relative to the body, a least one of said members adapted to be moved relative to the body to remove the one member from the bore whereby the cylindrical means can be removed from the body, and a groove extended transversely through the body, said groove having a portion intersecting a portion of the bore whereby the cylindrical means can be manually rotated within said bore to position a selected portion of the cylindrical means adjacent the slot.

22. The device of claim 21 wherein: the first and second members comprise a pair of pins.

23. The device of claim 21 wherein: the cylindrical means is a cylindrical stone material having a diameter that is slightly less than a diameter of the bore.

24. The device of claim 21 wherein: the first member comprises a first pin located within the first hole in the body and projected into the bore adjacent one end of the cylindrical means and the second member comprises a second pin located within the second hole in the body and projected into the bore adjacent the other end of the cylindrical means, at least one of said pins being vertically aligned with the slot and removable from the bore of the body to allow the cylindrical means to be removed from said body.

25. A device for sharpening longitudinal edges of a blade comprising: a body having opposite end walls and a longitudinal wall extended between the opposite end walls, said body having a longitudinal cylindrical bore open to each end wall and a longitudinal slot in said longitudinal wall, said slot extended normal to the longitudinal wall and open to the bore and said end walls for accommodating the blade, cylindrical means for sharpening longitudinal edges of the blade, said cylindrical means having opposite ends and a cylindrical outer surface of stone material located in said bore, a longitudinal section of said outer surface being aligned with said slot, said cylindrical means being rotatably supported by the body within the bore whereby different longitudinal sections of said outer surface can be aligned with said slot, said body having a transverse first hole adjacent one end of the cylindrical means and a transverse second hole adjacent the other end of the cylindrical means, first stop means located in said first hole to mount the first stop means on the body, said first stop means having a portion extended into the bore adjacent said one end of the cylindrical means, second stop means located in said second hole to mount the second stop means on the body, said second stop means having a portion extended into the bore adjacent said other end of the cylindrical means whereby said first and second stop means limit longitudinal movement of the cylindrical means relative to the body, and a transverse groove in said body, said groove having a portion intersecting a portion of the bore whereby the cylindrical means can be manually rotated within said bore to position a selected longitudinal section of said outer surface adjacent the slot.

26. The device of claim 25 wherein: the first stop means comprises a first member removably mounted on said body whereby the portion of the first stop means extended into the bore is removed from the bore to permit the cylindrical means to be removed from the body.

27. The device of claim 25 wherein: the first stop means comprises a first member removably mounted on said body, and said second stop means comprises a second member removably mounted on said body, whereby when at least one member is partly removed from the body the cylindrical means can be removed from the body.

28. The device of claim 25 wherein: the first and second stop means are pin means having first portions located in said holes to mount the pin means on the body and second portions extended into the bore adjacent opposite ends of the cylindrical means to limit longitudinal movement of the cylindrical means relative to the body, at least one of said pin means being partly removed from the body whereby the cylindrical means can be removed from the body.

* * * * *